United States Patent [19]

Sado

[11] 4,019,429

[45] Apr. 26, 1977

[54] VENTILATOR

[75] Inventor: Yukio Sado, Asahi, Japan

[73] Assignee: Yoshida Kogyo Kabushiki Kaisha, Tokyo, Japan

[22] Filed: Nov. 25, 1975

[21] Appl. No.: 635,174

[30] Foreign Application Priority Data

Nov. 28, 1974 Japan ..... 49-145410

[52] U.S. Cl. ..... 98/37; 98/98; 55/496

[51] Int. Cl.[2] ..... F24F 13/18

[58] Field of Search ..... 98/37, 96–99, 98/88 R, 99.6, 114, 13, 94, 99.2, 2, 11, 88 S; 55/495, 492

[56] References Cited

UNITED STATES PATENTS

| | | | |
|---|---|---|---|
| 2,561,928 | 7/1951 | Johnston | 98/99 R |
| 3,274,759 | 9/1966 | Bell, Jr. | 55/496 |
| 3,464,401 | 9/1969 | McGrath | 126/113 |

*Primary Examiner*—William E. Wayner

*Attorney, Agent, or Firm*—Hill, Gross, Simpson, Van Santen, Steadman, Chiara & Simpson

[57] ABSTRACT

A ventilator, constructed to serve as a horizontal rail in a building component, includes a pair of spaced apertured plates, the aperture of one being an air inlet vertically spaced below that of the other which is an air outlet, and filter and baffle means disposed in the path between said apertures, and so arranged that an air current flows through the filter at least twice.

8 Claims, 2 Drawing Figures

VENTILATOR

BACKGROUND OF THE INVENTION

1. Field of the Invention

This invention relates to ventilators and more particularly to a ventilator for use with window assemblies, doors or other building components.

2. Prior Art

There have heretofore been known various kinds of ventilators used in windows and doors. One of these ventilators generally comprises an inner plate having air vents on its upper edge, an outer plate having an air-intake opening at its lower edge, and a filter member provided in a hollow space partitioned by the inner and outer plates. The ventilator of this construction has a drawback in that it does not fully prevent stormy wind, and any dust or rain carried by such wind, from entering into the interior of a building in which it is installed. The primary reason for this malfunction is a dimensional restriction imposed upon the size of the ventilator for aesthetic purposes. In order to keep the height of the ventilator as short as possible and to make it look appealing, the air-intake opening and the vents are closely positioned with respect to each other, whereby the ventilator fails to completely restrict the admission of dust and rain carried by wind into the building interior.

SUMMARY OF THE INVENTION

With the above-mentioned prior art shortcomings in view, it is a primary object of this invention to provide a ventilator for use in windows, doors and the like that prevents wind of high velocity, and rain accompanying such wind, from entering directly into the building interior.

It is another object of the invention to provide a ventilator so constructed as to direct an air flow at least twice through a given filter, thereby substantially removing any dust from the air passing through the ventilator.

A further object of the invention is the provision of a ventilator which is compact in size and which is also simple in construction.

According to the invention, a ventilator includes a filter holder which has a hollow space covered by a screen, and baffle means directing all the air flow from the air intake through the screen into the hollow space, and again through the screen to the air vent means, thus excluding passage of both dust and rain therethrough. The major components are of uniform cross-section to enable extrusion thereof, and to provide complemental configurations for joining the components together, for providing a rail, and for providing drainage.

Other objects and advantages of the invention will become more apparent from the following description when read in conjunction with the accompanying drawing in which like reference numerals denote like parts through several views.

DESCRIPTION OF THE PREFERRED EMBODIMENT

Figure 1:
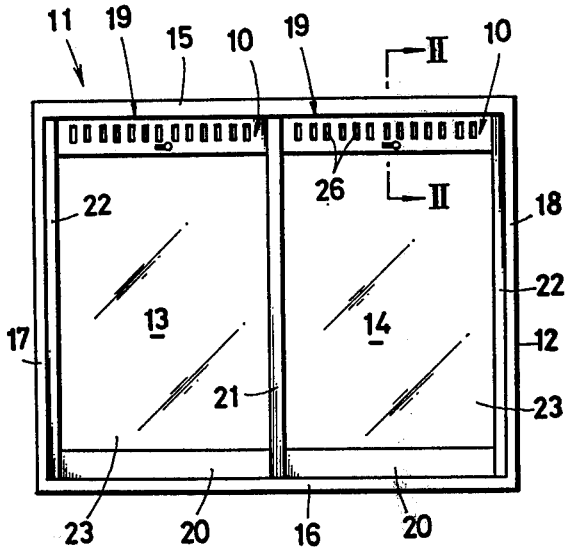
FIG. 1 is an elevational view of a ventilator embodying the invention which is attached to a window assembly of the horizontally movable type, and shown as viewed from the interior of a building.

In FIG. 1, a pair of ventilators 10 constructed in accordance with the invention are applied to a window assembly 11 of the horizontally sliding or rolling type that generally comprises a fixed frame 12 and a pair of relatively movable sashes 13, 14 mounted within the fixed frame 12 in parallel closely adjacent planes. The fixed frame 12 comprises a header 15, a sill 16 and a pair of side jambs 17, 18. The sashes 13, 14 are each provided with a top rail 19, a pair of stiles 21, 22, a lower rail 20, and a window glass pane 23. The ventilators 10, 10 are provided at the upper portions of the sashes and also constitute the top rail 19.

Figure 2:
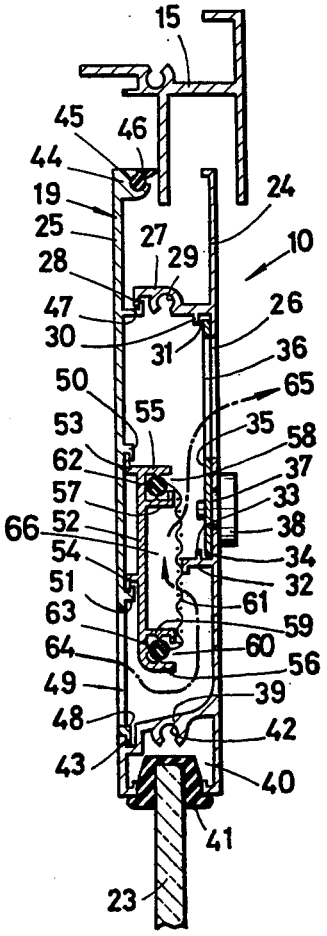
FIG. 2 is a vertical cross-sectional view taken along line II—II of FIG. 1.

As shown in FIG. 2, the ventilator 10 includes in general an inner plate 24 and an outer plate 25 which are preferably made of extrudable material, and which plates are spaced apart a predetermined distance from each other in the transverse direction of the ventilator 10 to provide a hollow interior therebetween. The inner plate 24 is provided with a plurality of longitudinally spaced-apart air vents 26. Above the air vents 26, an upper flange 27 extends outwardly at substantially right angles to the inner plate 24 toward the outer plate 25. A projection 28 extends downwardly from the outer end of the flange 27 and lies substantially parallel with the inner plate 24. Provided at the mid-portion of the upper flange 27 is a socket 29 for receiving therein a screw (not shown) for assembling the ventilator 10 to the stiles 21, 22. The inner plate 24 further extends upwardly from the flange 27 toward the header 15 for a purpose described below. Immediately beneath the flange 27 is provided a protrusion 30 which together with the plate 24 form a downwardly opening groove 31. An inverted-L-shaped partition or baffle 32 located under the position of the air vents 26 projects from the plate 24 toward the outer plate 25. A protrusion 33 provided on the upper surface of the partition 32 cooperates with the plate 24 in defining an upwardly opening groove 34. Slidably mounted in the grooves 31, 34 is an elongated adjustment plate 35 which is provided at its upper region with a plurality of slots 36 formed in registration with the air vents 26 in the inner plate 24. A handle 38 passes loosely through a horizontally elongated hole 37 in the inner plate 24 and is fixedly attached to a lower portion of the adjustment plate 35. The handle 38 is adapted for sliding the adjustment plate 35 horizontally so as to regulate the effective width of the air vents 26. The inner plate 24 is further provided adjacent to its lowermost end with a lower flange 39 extending outwardly therefrom. The upper surface of the lower flange is slanted downwardly from the inner plate 24 toward the frontal or distal end of the flange 39. The frontal end of the lower flange 39 is directed downwardly so as to extend substantially parallel with the inner plate 24. The downwardly directed distal end of the flange 39 together with the lowermost end of the inner plate 24 form a channel 40 for receiving therein the window glass pane 23 together with a suitable gasket or sealing material 41. Provided beneath the flange 39 is a socket 42 for receiving a screw (not shown) for assembling the ventilator 10 to the stiles 21 and 22. An upwardly open groove 43 is formed immediately above the depending portion of the lower flange 39.

The outer plate 25 at its top end has an inwardly directed flange 44 extending substantially at a right angle to the plate 25. The flange 44 has a groove 45 receiving therein an air-tight sealing strip or gasket 46, which frictionally engages with the header 15. The inner and outer plates 24, 25 not only form the framework of the ventilator 10 but also form the top rail 19. Beneath the flange 44 is a locking flange 47 extending inwardly to overlap and to engage the projection 28 of the upper flange 27. The lower end of the outer plate 25 has another locking flange 48 which tightly fits into the groove 43 formed in the flange 39 of the inner plate 24, so that the inner and outer plates 24, 25 are tightly interconnected with each other via the flanges 27, 39. This interconnection may be supplemented by sealing material (not shown) and is maintained by the stiles 21, 22 which snugly engage the ends of the plates 24, 25.

An air-intake opening 49 is provided immediately above the locking flange 48. The opening 49 is displaced vertically from the air vents 26, so that the opening 49 faces an imperforate portion of the inner plate 24, below the inverted-L-shaped partition 32.

Formed beneath the locking flange 47 and above the air-intake opening 49 is a pair of ridges 50, 51 spaced apart a predetermined distance and extending inwardly from the outer plate 25. The ridges 50, 51 slidably interengage with a pair of engaging members 53, 54 provided on the outer side of a filter-retaining means 52 and securely maintain the filter holder in the space between the inner and outer plates 24, 25 and the stiles 21, 22, the filter holder 52 being tightly engaged by the stiles 21, 22. The lowermost portion of the means 52 extends downwardly to an extent that it covers substantially half of the opening 49 so as to provide an elongated passage for the air to flow within the ventilator 10. At the upper end of the filter-retaining means 52, there is a ledge 55 which extends inwardly toward the inner plate 24. The lower end of the means 52 likewise has an inwardly extending ledge 56. Immediately beneath the ledge 55 is another ledge 57 an end portion of which extends upwardly and defines a laterally open groove 58. A similar groove 60 is defined above the ledge 56 by a ledge 59 whose end portion extends downwardly. Between the grooves 58, 60, there is a hollow space 66 opening toward the inner plate 24, but otherwise defined by imperforate elements. A filter 61, constructed of a screen or a sheet of porous material or any other suitable material, extends between the ledges 57, 59, in fully covering relation to the opening of the space 66. To maintain the filter 61 in the proper position, a pair of retainers 62, 63 are held in the grooves 58 and 60 respectively and frictionally engage the upper and lower ends or edges of the filter 61. The aforementioned inverted-L-shaped partition 32 extends outwardly toward the outer plate 25 and abuts against the filter 61.

A wind blowing in through the opening 49 of the outer plate 25 impinges upon the lower portion of the inner plate 24 opposite to the opening 49 beneath the filter holder 52 and is directed upwardly toward the inverted-L-shaped partition 32 which prevents the flow of high velocity air directly into the building interior. Since the inverted-L-shaped partition 32 abuts against the filter 61, the air is prevented from flowing between the partition 32 and the filter 61, and hence is forced through the filter 61 as indicated by the arrow 64. The air between the outer plate 25 and the filter 61 again passes through the filter 61, thence through the slits 36 and the air vents 26 into the interior of the building as shown by the arrow 65. The portion of the filter 61 below the partition 32 initially filters out dust from the air, and the portion of the filter above the partition 32 provides a secondary filtering of such air. Thus, the ventilator 10 directs the air twice through the filter 61, thereby substantially removing any dust from the air. Furthermore, any rain entering the air-intake opening 49 is effectively prevented from being admitted into the building interior even under stormy conditions because the rain directly impinges upon the angular surface of the lower flange 39 and/or on the inner plate 24 opposite the opening 49. The slanted surface of the flange 39 enables water thereon to drain out of the ventilator 10.

The ventilator 10 broadly comprises the apertured inner plate 24 and the apertured outer plate 25 interconnected by the end portions of the flanges 27, 39, and the filter retaining means 52 interposed between the plates 24, 25. The plates 24, 25 jointly constitute the upper rail 19, and thus the necessity of providing a conventional rail above the ventilator is eliminated. The lowermost portion of the filter-retaining means 52 extends downwardly over about one-half of the air-intake opening 49 and elongates the average passage length through which the air flows. The air entering the opening 49 takes a long meandering course within the hollow space and twice through the filter 61 before it goes into the interior of the building via the air vents 26. The longer the distance the air travels within the ventilator, the more its velocity will be reduced, thus increasing efficiency of dust removal. In spite of the long distance within which the air travels through the ventilator 10, the air intake-opening 49 and the air vents 26 are closely positioned with respect to each other, thereby minimizing the size of the ventilator and enabling an aesthetic appearance. As the filter retaining means 52 is separate from the outer plate 25, the structure of the outer plate is simple and facilitates the manufacture of the same. The air vents 26 may be provided on the lower portion of the inner plate 24 and the air-intake opening 49 on the upper portion of the outer plate 25. Additional partitions 32 vertically displaced from each other and abutting the filter 61 may be provided on the inner plate 24 and on the inner surface of the filter retaining means 52, for directing the air to pass through the filter 61 more than twice. The ventilator 10 has the sealing strip 46 provided at the upper end of the outer plate 25 so that any leakage of water or air at the edge of the ventilator can be avoided.

While the ventilator 10 of this invention has been shown as applied to a window assembly, it may also be applied to doors, walls or other building components.

Although a particular preferred embodiment of the invention has been disclosed in detail for illustrative purposes, it will be understood that various changes and modifications may be made without departing from the scope and spirit of the appended claims.

What is claimed is:

1. A ventilator for use in a building component comprising:

a. an inner plate having air vent means formed therein:

b. an outer plate near upper and lower margins secured to said inner plate and spaced therefrom in the transverse direction of the ventilator, and having an air-intake opening vertically displaced from said air vent means;

c. a filter-retaining means having grooves at its upper and lower edges, said filter-retaining means being disposed between and secured to one of said inner and outer plates;

d. a filter extending between said grooves across a hollow space therebetween and secured in said grooves; and e. a partition extending from the other of said inner and outer plates toward said one plate and abutting against said filter for directing a flow of air at least twice through said filter.

2. A ventilator as claimed in claim 1, said inner plate having upper and lower flanges extending outwardly into engagement with and joined to said outer plate.

3. A ventilator according to claim 1 in which said filter retaining means is imperforate between said grooves.

4. A ventilator according to claim 1 in which there is a horizontally slidable connection between said filter-retaining means and said one plate.

5. A ventilator according to claim 1 in which the air-intake opening is below said air vent means, and including a flange extending between said plates at the air-intake opening, and sloping downwardly to the lower edge of said air-intake opening in said outer plate.

6. A ventilator according to claim 5 in which said inner plate is imperforate between said flange and said filter.

7. A ventilator according to claim 1 in which said filter-retaining means extends partially over said air-intake opening.

8. A ventilator according to claim 1 in which said inner plate has a portion extending beyond said air vent means, and said outer plate having flange means at one end cooperating with said extending portion of said inner plate to jointly form a rail.

* * * * *